United States Patent [19]

Ferara

[11] 3,966,518

[45] June 29, 1976

[54] PAPERBOARD CORRUGATOR

[75] Inventor: James T. Ferara, William A. Massey, both of Gibbsboro, N.J.

[73] Assignee: Molins Machine Company, Inc., Camden, N.J.

[22] Filed: Dec. 26, 1973

[21] Appl. No.: 428,296

[52] U.S. Cl. ..... 156/64; 156/205; 156/351; 156/361; 156/378; 156/470

[51] Int. Cl.[2] ..... G05G 15/00

[58] Field of Search ..... 156/64, 205, 210, 351, 156/361, 378, 462, 470, 472

[56] References Cited

UNITED STATES PATENTS

| | | | |
|---|---|---|---|
| 2,482,627 | 9/1949 | Langston | 156/367 |
| 3,004,880 | 10/1961 | Lord | 156/210 |
| 3,104,997 | 9/1963 | Stewart et al. | 156/210 |
| 3,411,388 | 11/1968 | Rappaport | 156/64 |
| 3,510,374 | 5/1970 | Walker | 156/64 |

*Primary Examiner*—William A. Powell
*Assistant Examiner*—David A. Simmons
*Attorney, Agent, or Firm*—Seidel, Gonda & Goldhammer

[57] ABSTRACT

Method and apparatus are disclosed for monitoring the quantity of single face paperboard on the bridge of a corrugator so that a unit length of paperboard will remain on the bridge for a preselected time irrespective of the speed of the corrugator to properly season the paperboard. Signals indicative of input and output of paperboard to the bridge are compared with a signal indicative of a preselected time and a signal is generated to effect changes in the single facer machine motor speed.

5 Claims, 2 Drawing Figures

10
12
16
18
20
22
24
26
28
30
32
34
36
38
40
48
50
52
54
56
58
60

64
36
38
66
PRESET
70
UP - DOWN COUNTER
88
DIGITAL COUNTER
86
DIGITAL-ANALOG CONVERTER
84
ANALOG-DIGITAL CONVERTER
74
TACH.
SINGLE FACER DRIVE POWER UNIT
78
MOTOR
82
SINGLE FACER MACHINE
22
POWER CONTROL PANEL
76
POWER SOURCE

PAPERBOARD CORRUGATOR

This invention is directed generally to a corrugator for manufacturing double face corrugated paperboard. A paperboard corrugator includes at least one single facer machine and a double facer machine coupled by a bridge. Conventionally, due to the nature of corrugated paperboard manufacturing operations, the single facer machine and double facer machine are driven at different speeds. As a result of said different speeds, a surplus of single face corrugated paperboard is produced and stored on the bridge. In this manner, the speed of the single facer may be reduced or stopped, as occasioned for example to facilitate changing rolls at the single facer machine, while the double facer machine continues to run and consume the surplus single face paperboard stored on the bridge.

It has recently been suggested that the single facer and double facer machines should be run synchronously. At the same time, it was suggested that a uniform length of single face paperboard remain on the bridge while running regardless of the speed of either machine. I believe this to be an undesirable condition because the single face paperboard may be on the bridge a greater or lesser time than is preferred for the specific moisture level of the single face paperboard. Hence, there can be a mismatch between the moisture level of the single face paperboard and the moisture level of the liner to be joined thereto at the double facer machine. If the moisture levels of the single face paperboard and liner are not balanced, the finished paperboard may warp and subsequent box forming operations may be impeded.

In accordance with the present invention, I count the input to and the output from the bridge to ascertain the quantity of single face paperboard on the bridge and then generate a quantity signal. The quantity signal is compared with a control signal indicative of the optimum time for the board to remain on the bridge, and an output signal is generated to control the single facer drive power unit. While the prior art tried to keep the total length of single face paperboard on the bridge substantially constant, the present invention seeks to maintain a unit length of single face paperboard on the bridge for a preselected time irrespective of the speed of the corrugator. The preselected time is a function of the time needed to season the single face paperboard.

It is an object of the present invention to provide a novel paperboard corrugator.

It is another object of the present invention to provide a paperboard corrugator constructed and arranged to combine webs having balanced moisture levels.

It is another object of the present invention to provide a novel corrugator for maintaining a unit length of single face paperboard on the bridge for a preselected time irrespective of speed.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
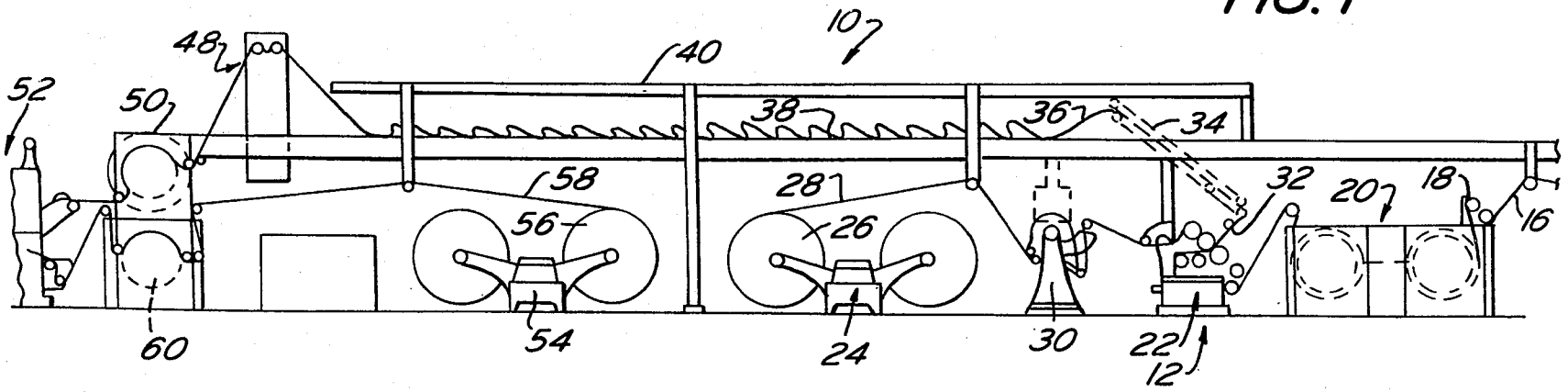
FIG. 1 is a diagrammatic side elevation of a portion of a corrugator.

Referring to the drawing in detail, wherein like numerals indicate like elements, there is shown in FIG. 1 a corrugator designated generally as 10. Corrugator 10 at its upstream or input end includes at least one single facer system 12.

The single facer system 12 includes a first mill roll stand, not shown, for supporting rolls of a liner 16. The liner 16 is fed through a tension control device 18 and is then lead through a preheater 20. The preheated liner 16 is then fed to the single facer machine 22.

A second mill roll stand 24 is provided for supporting rolls 26 of a corrugating medium 28. The corrugating medium 28 is fed through a preconditioner 30 having a steam shower system. The preconditioned corrugating medium 28 is then fed to the single facer machine 22 where it is corrugated and adhesively bonded to the liner 16, forming a web 36 of single face paperboard. At the discharge side of the single facer machine 22, there may be provided a web break detector 32 for detecting the presence or absence of the web 36 of single face paperboard. The web 36 is fed by conveyor 34 to the adjacent bridge 38. If a second single facer system is utilized in conjunction with system 12, the single face web from the second system will be fed to the upper level 40 of the bridge.

As the web 36 leaves the bridge 38 it extends around the guide surface on the guide 48. Thereafter, the web 36 is heated by the drum 50 which is heated in any conventional manner, such as by steam. Thereafter, the preheated web 36 is fed to the double facer machine 52.

A mill roll stand 54 is situated beneath the bridge 38 and supports one or more rolls 56 of a second liner 58. The liner 58 is preheated such as by partially extending around heated drum 60. At the entrance to the double facer machine 52 a glue machine applies an adhesive bonding agent to the crests of the flutes on the web 36 which are then bonded to the liner 58 in the double facer machine 52.

The double facer machine 52 includes a source of heat below the web of paperboard. The source of heat is preferably a plurality of heat chests or plates which may be selectively moved to a minimal heat transfer position as desired. In this regard, the selectivity is provided to facilitate the proper heat transfer as a function of speed with the object of attaining uniform moisture level in the paperboard to prevent warp.

Figure 2:
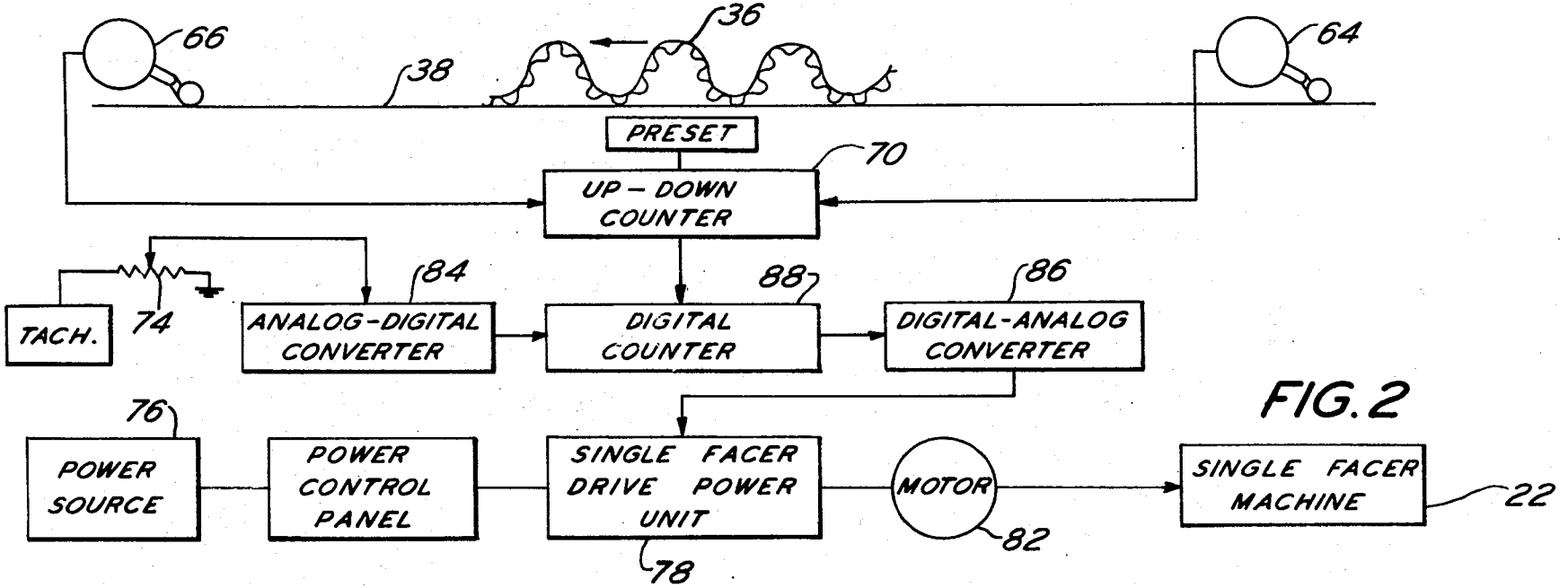
FIG. 2 is a diagrammatic illustration of the controls associated with the corrugator shown in FIG. 1.

Referring to FIG. 2, a sensor device 64 is diagrammatically illustrated at the inlet end of the bridge 38 to sense the board input and generate a signal corresponding to the footage of single face board introduced to the bridge 38. A similar sensor device 66 is provided at the outlet end of the bridge 38 to measure the footage of single face board drawn from the bridge 38 and generate a signal equivalent thereto. These signals are fed to an up-down counter 70. The signal from sensor device 64 causes counter 70 to count up while the signal from sensor device 66 causes counter 70 to count down. Counter 70 is preset to a value corresponding to the nominal length of board on the bridge 38 and a corresponding quantity signal is generated. The sensor devices 64,66 could be of a type capable of counting the number of flutes in the single face web 36 passing a given point, or count uniformly spaced printed marks on the web 36, or could be frictionally driven by the board, or driven by other means. If the flutes are counted, this could be accomplished optically or by use of a cog wheel meshed with the flutes and in driving relation with a pulse generator.

The quantity signal corresponding to the amount of board on the bridge 38 is fed from counter 70 to a digital difference comparator 88. The desired time of the board to be retained on the bridge is set by the operator on an analog attenuator 74, which receives a signal from a tachometer coupled to the double facer machine 52. The output of the attenuator 74 is converted to digital form in an analog-digital converter 84. The comparator 88 then compares the digital control signal from the converter 84 with the digital quantity signal from the up-down counter 70 to generate a digital discrepancy signal.

The digital discrepancy signal is further converted by the digital-analog converter 86 to an analog control signal which is transmitted to the single facer drive control unit 78 which in turn controls the speed of the motor 82 on the single facer machine 22. The control signal increases or decreases the speed of the single facer machine 22 to maintain a unit length of web 36 on the bridge 38 to properly season the web 36 for a preselected time irrespective of the speed of the double facer machine 52.

The single facer machine 22 may run at a speed which is higher than, even with, or lower than the speed of the double facer machine 52 in order that the unit length of web 36 remains on the bridge 38 for the preselected time regardless of speed. By way of example, it will be assumed that C-flute single face paperboard is being run using 26 pound medium and liners, each having 5% moisture. The moisture content of a roll is usually designated thereon by the mill. Also, let it be assumed that a conventional 20 second starch adhesive is being used. The operator, based on past experience with these materials, would select a time interval of 60 seconds for storage of the web 36 on the bridge 38. An appropriate value is set by the operator on the analog attenuator 74.

Let it be assumed that the bridge 38 is 60 feet long whereby the speed of input must be 60 feet per minute and the speed of output from the bridge 38 must be 60 feet per minute. If the speed of the double facer machine 52 is increased to 120 feet per minute, the consumption of web 36 from the bridge 38 must be at the rate of 2 feet per second. To provide a surplus of single face paperboard on the bridge 38 so that the unit length of web 36 is on the bridge 38 for 60 seconds, the input to the bridge 38 must be 3 feet per second which is equivalent to a speed of 180 feet per minute by the single facer machine 22.

As the speed of the double facer machine 52 increases from 60 feet per minute to 120 feet per minute, the sensor device 66 will sense this change and generate a signal which is communicated to the counter 70. The quantity signal from counter 70 will be compared with the control signal and an analog output signal will be generated to cause the single facer machine 22 to speed up to 180 feet per minute.

The bridge 38 is able to absorb the increased production from the single facer machine 22 due to the loops formed in the web 36. At 60 feet per minute, for instance, the web 36 will traverse a 60 foot long bridge without any loops. As the speed increases, the overrunning speed of the single facer machine 22 causes the number of loops in the web 36 on the bridge 38 to increase at a corresponding rate.

The sensors 64,66 are, per se, well known to those skilled in the art and may be commercially available products such as Veeder Root rotary pulse generator, Series 7109. Likewise, the up-down counter 70 may be a Tenor Series 720 and the digital difference counter may also be a Tenor Series 720. The converters 84,86 may be of the type made by Datel Systems, Inc.

The system illustrated in FIG. 2 is representative of an arrangement which permits the amount of the digital discrepancy signal to be exhibited on an indicator or recorder. If desired an analog integrator may be substituted for counter 70 to thereby generate an analog quantity signal which may be compared with the analog signal of attenuator 74 to thereby produce an analog output signal. In that case, converters 84 and 86 would not be required.

The power source 76, which is coupled to the single face drive control unit 80, attempts to cause the single facer machine 22 to operate at the same speed as the double facer machine 52. Due to instrument errors, a positive or negative drift can occur. The output signal of this invention is superimposed over the signal from source 76 to attain the proper speed for the single facer machine 22.

The present invention may be embodied in other specific forms without departing from the spirit or essential attributes thereof and, accordingly, reference should be made to the appended claims rather than to the foregoing specification as indicating the scope of the invention.

I claim:

1. A method of producing corrugated paperboard wherein single face paperboard is fed from a single facer machine to a bridge and withdrawn from the bridge by a double facer machine comprising the steps of generating a quantity signal indicative of the rates at which single face paperboard is fed to and removed from the bridge, automatically generating a control signal indicative of a desired time a unit length of the single face paperboard should remain on the bridge by modifying a signal indicative of the speed of the double facer machine, automatically comparing said signals and generating an output discrepancy signal, and using the output discrepancy signal to automatically control the speed of the single facer machine so that a unit length of single face paperboard remains on the bridge a preselected time.

2. A method in accordance with claim 1 including converting the quantity and control signals to digital form before said comparing step, and converting the output signal from digital to analog form.

3. A method in accordance with claim 1 wherein said output signal is combined with a signal indicative of the speed of the double facer machine.

4. A method in accordance with claim 1 wherein said step of generating a quantity signal includes counting the flutes on single face paperboard fed to and removed from the bridge.

5. In a corrugator wherein single faced paperboard from a single facer machine is fed to a bridge and withdrawn from the bridge by a double facer machine comprising means coupled to said single facer machine for controlling the speed thereof so that a unit length of single faced paperboard remains on the bridge for a predetermined time regardless of variations in the speed of the double facer machine, said means including a first device for detecting the amount of single facer paperboard fed to the bridge and for generating a signal indicative thereof, a second device for detecting the amount of single faced paperboard removed from the bridge and for generating a signal indicative thereof, a comparator means coupled to said devices for comparing said signals and generating a quantity signal, means for generating a control signal indicative of a desired amount of time the single faced paperboard should remain on the bridge, means for automatically comparing said quantity signal with said control signal and for generating an output signal, said last mentioned means being connected to the drive unit of a single facer machine to automatically vary the speed of the single facer machine as a function of said output signal.

* * * * *